US007201051B2

(12) United States Patent
Wang et al.

(10) Patent No.: US 7,201,051 B2
(45) Date of Patent: Apr. 10, 2007

(54) METHOD FOR DETECTING FUEL IN OIL OF AN INTERNAL COMBUSTION ENGINE

(75) Inventors: Su-Chee Simon Wang, Troy, MI (US); Ming-Cheng Wu, Troy, MI (US); Yingjie Lin, El Paso, TX (US); Taeyoung Han, Bloomfield Hills, MI (US); Mark K. Krage, Troy, MI (US)

(73) Assignee: Delphi Technologies, Inc., Troy, MI (US)

( * ) Notice: Subject to any disclaimer, the term of this patent is extended or adjusted under 35 U.S.C. 154(b) by 61 days.

(21) Appl. No.: 10/994,154

(22) Filed: Nov. 19, 2004

(65) Prior Publication Data

US 2006/0107734 A1 May 25, 2006

(51) Int. Cl.
*G01F 23/00* (2006.01)

(52) U.S. Cl. ..... 73/291; 324/698

(58) Field of Classification Search ..... 324/698; 73/291

See application file for complete search history.

(56) References Cited

U.S. PATENT DOCUMENTS 3,678,749 A * 7/1972 Harper ..... 73/304 R
5,789,665 A * 8/1998 Voelker et al. ..... 73/53.05
5,824,889 A * 10/1998 Park et al. ..... 73/116
6,557,396 B2 * 5/2003 Ismail et al. ..... 73/53.05
6,590,402 B2 * 7/2003 Wang et al. ..... 324/698

* cited by examiner

*Primary Examiner*—Michael Cygan
(74) *Attorney, Agent, or Firm*—Paul L. Marshall

(57) ABSTRACT

A method for detecting fuel leaking into an oil pan containing oil which is used to lubricate an internal combustion engine utilizes a plurality of sensors. The method includes the step of measuring a plurality of parameters of the oil using each of the plurality of sensors to create measured values. A fuel leakage value is calculated incorporating each of the measured values. The method then determines when the fuel leakage value exceeds a predetermined value.

14 Claims, 4 Drawing Sheets

METHOD FOR DETECTING FUEL IN OIL OF AN INTERNAL COMBUSTION ENGINE

BACKGROUND ART

1. Field of the Invention

The invention relates to a method for measuring the characteristics of oil in an internal combustion engine. More specifically, the invention relates to measuring the characteristics of oil of the internal combustion engine to determine when the oil condition has degraded due to the presence of fuel.

2. Description of the Related Art

More and more attention is being focused on fuel economy with regard to internal combustion engines of motor vehicles. Internal combustion engines that run on diesel fuel have higher fuel economy than those that run on regular gasoline. Motor vehicles operated using diesel fuel have their disadvantages. One disadvantage is the perception that internal combustion engines operating on diesel fuel produce more air and noise pollution. Currently, technological advances have been made to reduce both types of pollution.

Another problem with diesel fuel operated internal combustion engines is fuel leakage. Diesel fuel tends to leak into the oil of an internal combustion engine. The diesel fuel that is added to the oil decreases the viscosity of the oil, regardless of the brand. As the viscosity of the oil drops, as is shown in FIG. 3, the oil can no longer form a continuous lubricating film on the components of the internal combustion engine, even under normal operating conditions. The absence of a lubricating film on those components will increase the friction therebetween considerably to the point where it could cause severe or catastrophic wear damage. Fuel leakage into oil also adds to the air pollutants that are emitted by the internal combustion engine.

An attempt to detect fuel leakage into the oil reserve may be attempted by measuring the level of oil in an oil pan. This method has serious limitations. First, by only measuring the level of oil in the oil pan, it cannot be distinguished as to whether diesel fuel is entering the oil or whether coolant is entering the oil. Second, simple oil level detection alone will be triggered when oil is added to the internal combustion engine.

SUMMARY OF THE INVENTION

A method for detecting fuel leaking into an oil pan containing oil which is used to lubricate an internal combustion engine utilizes a plurality of sensors. The method includes the step of measuring a plurality of parameters of the oil using each of the plurality of sensors to create measured values. A fuel leakage value is calculated incorporating each of the measured values. The method then determines when the fuel leakage value exceeds a predetermined value.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
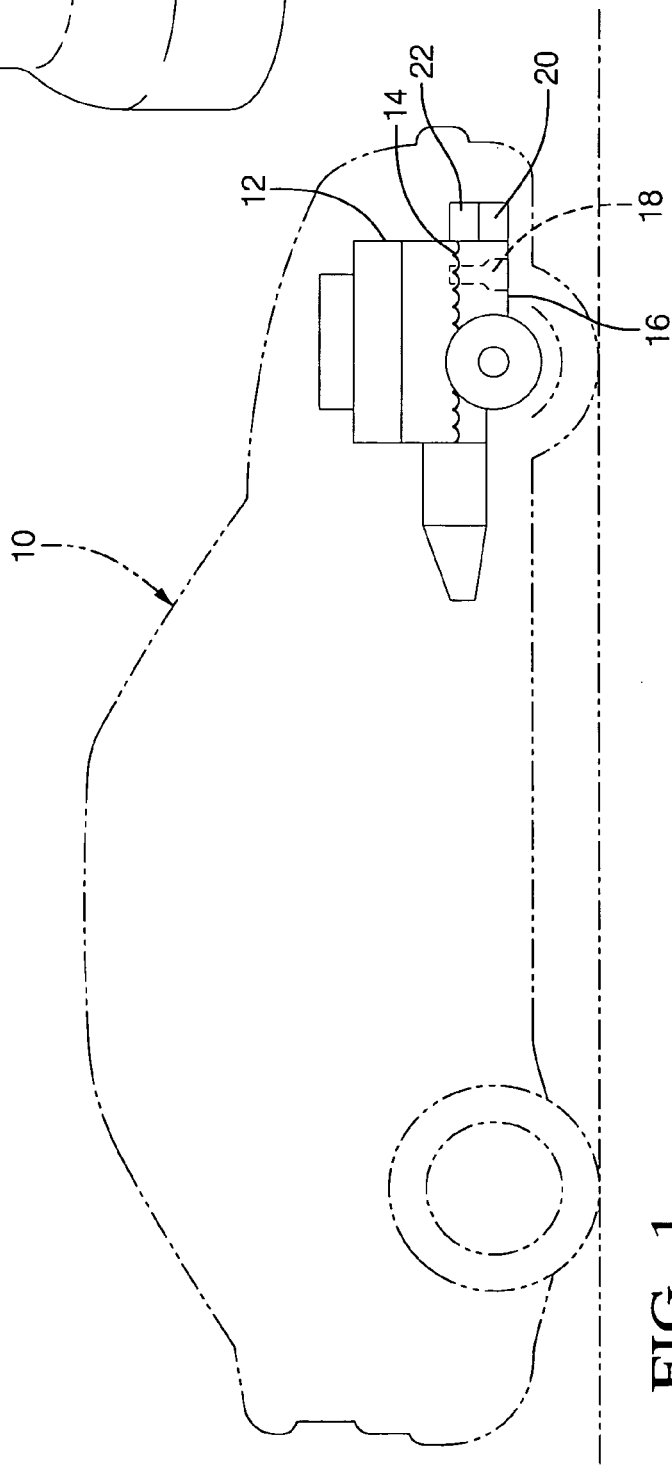
FIG. 1 is a schematic side view, partially cutaway, of a motor vehicle powered by an internal combustion engine.

Referring to FIG. 1, a motor vehicle 10 is shown schematically and partially cutaway. The cutaway portion of the motor vehicle 10 shows that it is powered by an internal combustion engine 12. The internal combustion engine 12 is powered by diesel fuel and lubricated by oil, graphically represented by oil level 14. A reserve of oil is stored in an oil pan 16 that is typically disposed below the internal combustion engine 12. An oil sensor 18 is shown in phantom within the oil pan 16. Outputs from the oil sensor 18 are received by a control unit 20 which stores values for sensed parameters in a memory 22 electronically connected to the control unit 20.

Figure 2:
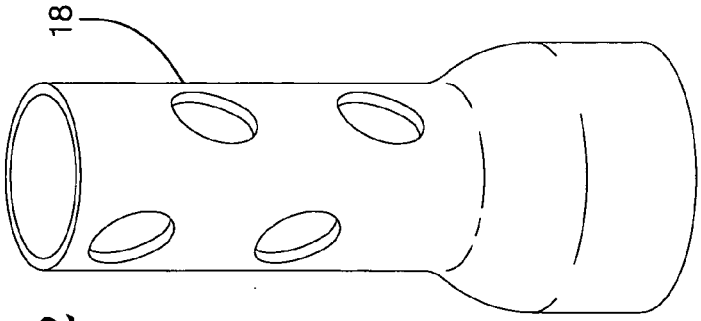
FIG. 2 is a perspective view of a sensing assembly incorporating a plurality of sensors.

Referring to FIG. 2, a perspective view of the oil sensor 18 is generally shown. The oil sensor 18 is a composite sensor assembly that incorporates a number of different sensors. Each of these sensors measures a property of the oil, which is then fed to the control unit 20 for processing and for storage of values in the memory 22. The physics of the oil sensor 18 are not the subject of this invention. It should be appreciated by those skilled in the art that appropriate sensor technology should be used when performing the method of the inventions disclosed herein.

Figure 3:
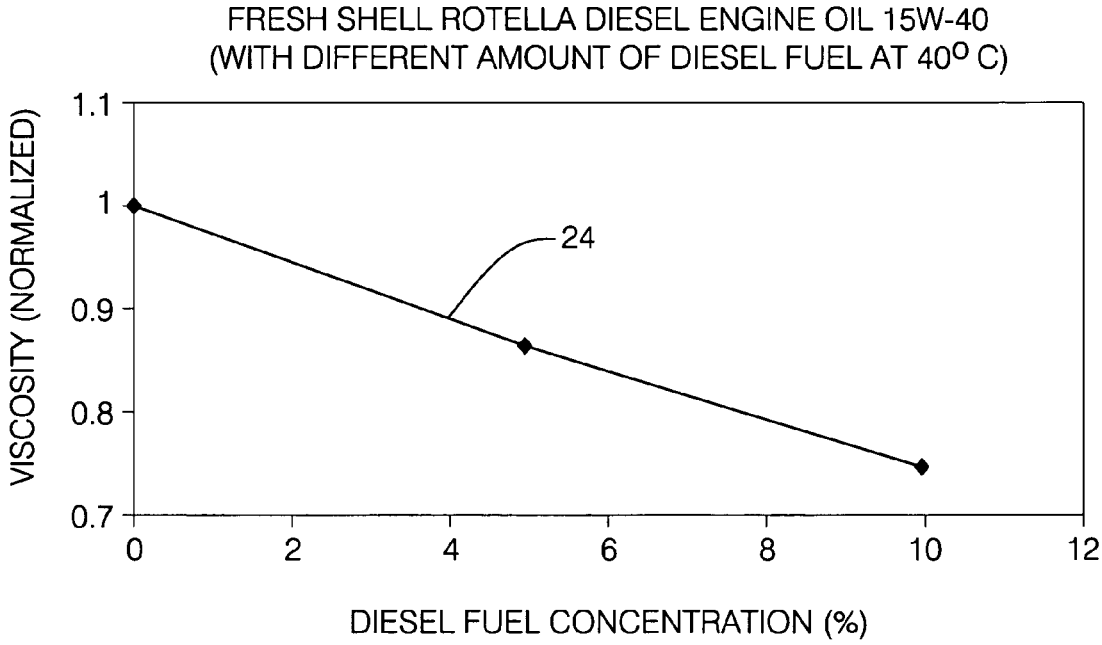
FIG. 3 is a graph of normalized oil viscosity as a function of diesel fuel concentrated.

Returning attention to FIG. 3, a plot of viscosity as a function of diesel fuel concentration is shown at 24. The viscosity plot 24 is normalized. The engine oil used to create this viscosity plot 24 has a weight of 15W-40 and is sold under the trademark Shell Rotella. The oil maintained a temperature of 40° Celsius throughout the plot 24. The viscosity of the oil decreased by 14% after the addition of diesel fuel to represent 5% of the volume of the combined fluid was diesel fuel. The viscosity of the oil declines by 20% as the fuel concentration approaches 8%. In order to safeguard the components of the internal combustion engine 12, it is desired to detect a fuel leakage before the fuel concentration reaches 8%. Therefore, in the preferred embodiment, the target for the oil sensor 18 is set to detect diesel fuel levels of 5%.

Figure 4:
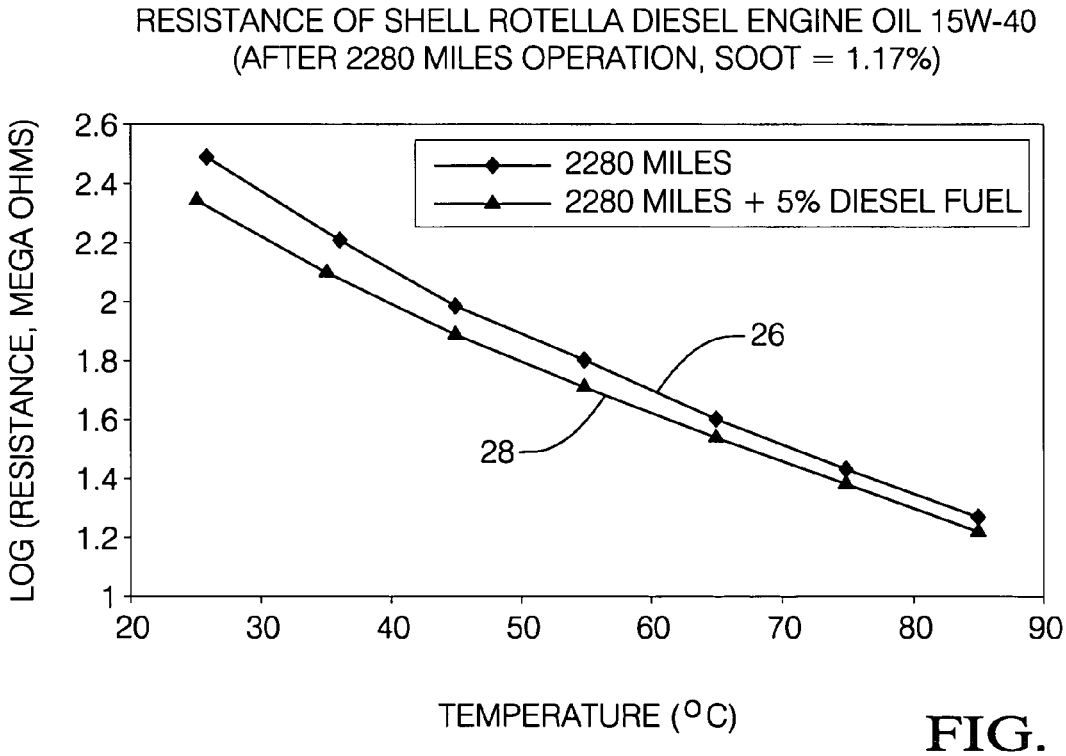
FIG. 4 is a graph showing electrical resistance of oil as a function of temperature.

Referring to FIG. 4, two resistance plots are shown as a function of temperature. A first resistance plot 26 is a graphic representation of the electrical resistance, in mega Ohms as a function of temperature after the internal combustion engine has traveled the equivalent of 2280 miles. A second resistance plot 28 represents the same parameters with the addition of 5% diesel fuel added to the oil. While both resistance plots 26, 28 show a decrease in resistance as the temperature increases, the resistance of pure engine oil is always greater than the resistance of the oil/diesel fuel combination at the same temperature.

Figure 5:
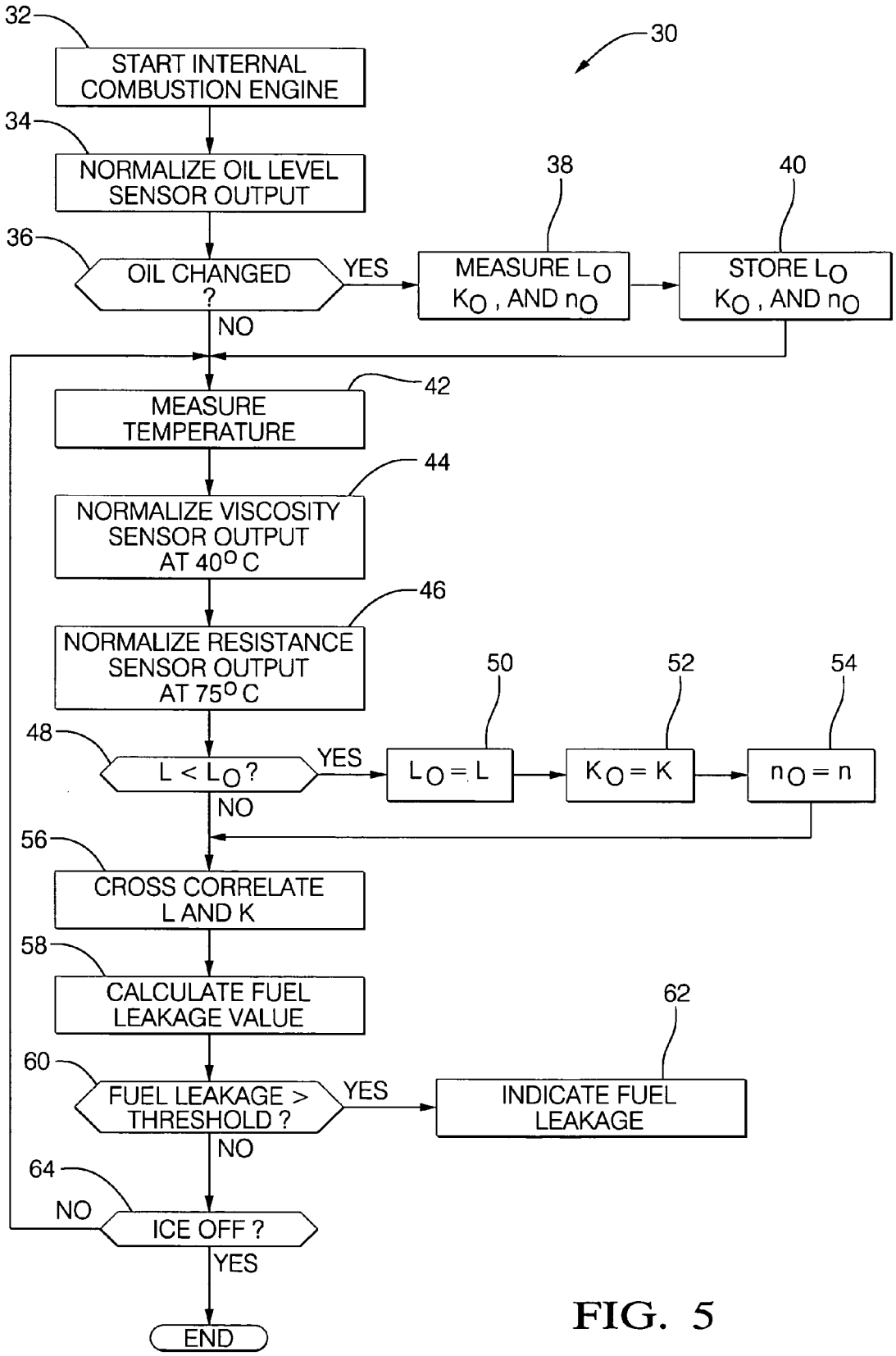
FIG. 5 is a logic chart of one embodiment of the invention.

Referring to FIG. 5, one embodiment of the inventive method is generally indicated at 30. The method 30 begins when the internal combustion engine 12 is started at 32. Once started, an oil level sensor is activated and the output is normalized at 34. The oil level sensor generates a signal, L, which can be divided into two parts, the true signal l and the error Δl as represented by $$L=l\pm\Delta l \quad \text{Equation 1}$$

wherein a typical oil level sensor has a maximum error ratio of Δl/l being equal to approximately 3%.

The method 30 then continues to determine whether the oil has been changed at 36. If the oil has been changed, measurements of oil level L, electrical resistance R, and viscosity υ are taken at 38. Returning attention to FIG. 2, the resistance of engine oil at 75° Celsius decreases by 11% when 5% of the volume of the oil/diesel fuel mixture is attributable to diesel fuel. It is, however, known that adding fresh oil to the crankcase causes the resistance to decrease. In addition, normal engine oil degradation will also cause a reduction in the resistance. Therefore, monitoring resistance R alone cannot specifically detect fuel leakage. The signal measured from the oil condition sensor can be divided into two parts they being $$R=r\pm\Delta r \quad \text{Equation 2}$$

wherein, r is the true signal and Δr is the error and Δr/r equals 5%.

The signal measured from the viscosity sensor can be divided in two parts, they being $$\upsilon=\upsilon\pm\Delta\upsilon \quad \text{Equation 3}$$

wherein υ is the value for viscosity, Δυ is the error in the signal generated by the viscosity sensor and Δυ/υ should not exceed 5%. Once the viscosity υ and resistant R are measured, their respective inverses are calculated and shall be referred to as $K_o$ and $\eta_o$, respectively. $K_o$ and $\eta_o$, along with the oil level $L_o$ are stored in memory 22 at 40. These are the values against which the operating engine will test the ongoing measured data.

As is stated above, the initial values for level $L_o$, the inverse of the resistance $K_o$, and the inverse of viscosity $\eta_o$ are stored at 40. The temperature is then measured at 42. Once the temperature reaches 40° Celsius, the output of the viscosity sensor is normalized at 44 and, when the temperature of the oil reaches 75° Celsius, the output of the resistance sensor is normalized at 46. The method 30 then compares the current level of oil L against the initial oil level $L_o$ to determine which is greater. If, at 48, the initial oil level $L_o$ is greater than the current oil level L, it is determined that some of the oil has burned off during normal operation of the internal combustion engine 12. If this is the case, the original oil level $L_o$ is replaced with the current level L at 50. Likewise, the original value for the inverse of the resistance $K_o$ is replaced with the calculated inverse of the current resistance at 52 and the calculated inverse of the viscosity $\eta_o$ is replaced with the current calculated inverse of the measured viscosity at 54.

Once the new initial values are calculated and stored, a cross correlation step for the oil level L and the inverse of the resistance K occurs at 56. This cross correlation step 56 would occur in the method 30 if it was determined that the original level of oil $L_o$ was equal to or greater than the oil level L, which was determined at step 48. The cross correlation step 56 is performed because an increase in oil level L could be attributed to either the addition of diesel fuel or the addition of fresh oil. By way of example, adding one quart of fresh oil to a four quart oil pan 16 will increase the oil level L by 33% and increase the inverse of the resistance K by 10%. Therefore, a cross correlation of oil level occurs through the following equations $$\overline{\omega}_k=e^{-D|\Delta l-\alpha\Delta k|} \quad \text{Equation 4}$$

$$\overline{\omega}_\eta=e^{-D|\Delta l-\beta\Delta\eta|} \quad \text{Equation 5}$$

wherein $\omega_K$ and $\omega_\eta$ are the cross correlation function of oil level L and resistance K, and oil level L with viscosity η, respectively. Continuing with equations 4 and 5, above, α is a correlation parameter for the oil level L and resistivity K. β is a correlation parameter for the oil level L and viscosity η. When Δl approaches αΔK, the change in oil level L is related to the change in resistivity K associated with a fuel leakage. Likewise when Δl approaches αΔη, the change in oil level L is related to the change in oil viscosity η associated with a fuel leakage. The correlation functions are close to one whenever the magnitude of the oil level L increase is correlated with the change in resistance Δk or the change in viscosity Δη. These functions effectively suppress the changes in output from the oil level sensor that are not related to fuel leakage. D is a parameter in equations 4 and 5 that controls the damping of the two correlation functions, and varies between 0 and 1. As the value of D increases, the correlation functions decay fast when the oil level L changes are not correlated with a fuel leakage. Through iterative steps, the value of D may be fine tuned. An initial value for D is, however, recommended to be approximately 0.5 for smooth decay of the correlation functions.

Once the cross correlation step 56 is completed, a fuel leakage value FL is calculated at 58. The fuel leakage value FL is calculated using $$FL=L\times K\times\eta \quad \text{Equation 6}$$

As diesel fuel leaks into the oil, the oil level L will increase proportionately, the resistance K will decrease and the viscosity η will decrease. The variation of the fuel leakage value FL due to an increase in fluid volume of 5% due to fuel leakage can be calculated as follows:

$$FL = 1.05\times\frac{1}{0.89}\times\frac{1}{0.86} = 1.37 \quad \text{Equation 7}$$

Thus, there is a 37% increase in the fuel leakage value FL for an additional 5% diesel fuel leakage into the oil. The intrinsic fluctuation of the fuel leakage value FL due to sensor noise can be calculated as follows:

$$\begin{aligned} FL &= L\times K\times\eta \quad \text{Equation 8} \\ &= (l\pm\Delta l)\times(k\pm\Delta k)\times(\eta\pm\Delta\eta) \\ &= lk\eta\pm(lk\Delta\eta+k\eta\Delta l+l\eta\Delta k)\pm \\ &\quad (l\Delta k\Delta\eta+k\Delta\eta\Delta l+\eta\Delta l\Delta k)\pm(\Delta l\Delta k\Delta\eta) \end{aligned}$$

Since (lΔkΔη+kΔηΔl+ηΔlΔk) and ΔlΔkΔη are relatively small, Equation 8 simplifies to $$FL = lk\eta\pm(lk\Delta\eta+k\eta\Delta l+l\eta\Delta k) = lk\eta+\Delta FL. \quad \text{Equation 9}$$

The intrinsic fluctuation of fuel leakage, ΔFL, as a percentage of lkη can be calculated using $$\begin{aligned} \frac{\Delta FL}{lk\eta} &= \frac{(lk\Delta\eta+k\eta\Delta l+l\eta\Delta k)}{lk\eta} \quad \text{Equation 10} \\ &= \frac{\Delta\eta}{\eta}+\frac{\Delta l}{l}+\frac{\Delta k}{k} \\ &= (5\%+3\%+5\%) \\ &= 13\%. \end{aligned}$$

As is shown by equations 7 and 10, the increase of the fuel leakage value FL due to 5% increase in volume due to fuel leakage is almost three times greater than the intrinsic noise of the oil sensor 18. With the cross correlation values, the fluid level value FL can be calculated using $$FL=L\times(\overline{\omega}_k\times K)\times(\overline{\omega}_\eta\times\eta) \qquad \text{Equation 11.}$$

Once the fuel leakage value FL is calculated using the cross correlation functions (equations 4 and 5, above), it can be determined whether the fuel leakage value FL is greater than a predetermined value or threshold at 60. Because the fuel leakage FL for a 5% fuel leakage is 1.37, a warning threshold should be set at a value smaller than 1.37 e.g., 1.20. If the fuel leakage value FL is greater than the warning threshold, a warning is indicated at 62. If not, it is determined whether the internal combustion engine 12 is turned off at 64. If not, the method iteratively loops back to step 42 where the temperature is measured.

Since the physical and chemical properties of the oil would change gradually and continuously due to aging effects of normal wear, the references $L_o$, $K_o$ and $\eta_o$ saved in memory 22 have to be reset periodically. Under normal engine operation, the oil level L would drop slowly due to the loss or burning of engine oil in the internal combustion engine 12. If the measured oil level L continues to decline, there should not be any significant diesel fuel leakage. Therefore, it should be appropriate to reset all of the references $L_o$, $K_o$ and $\eta_o$ in steps 50, 52, 54 respectively. As mentioned previously, the oil sensor 18 may have a level output that could have a plus or minus 3% error. Therefore, the fact that the oil level L is less than the reference for the oil level $L_o$ does not necessarily mean the oil level 14 in the oil pan 16 is actually less than the reference $L_o$.

Figure 6:
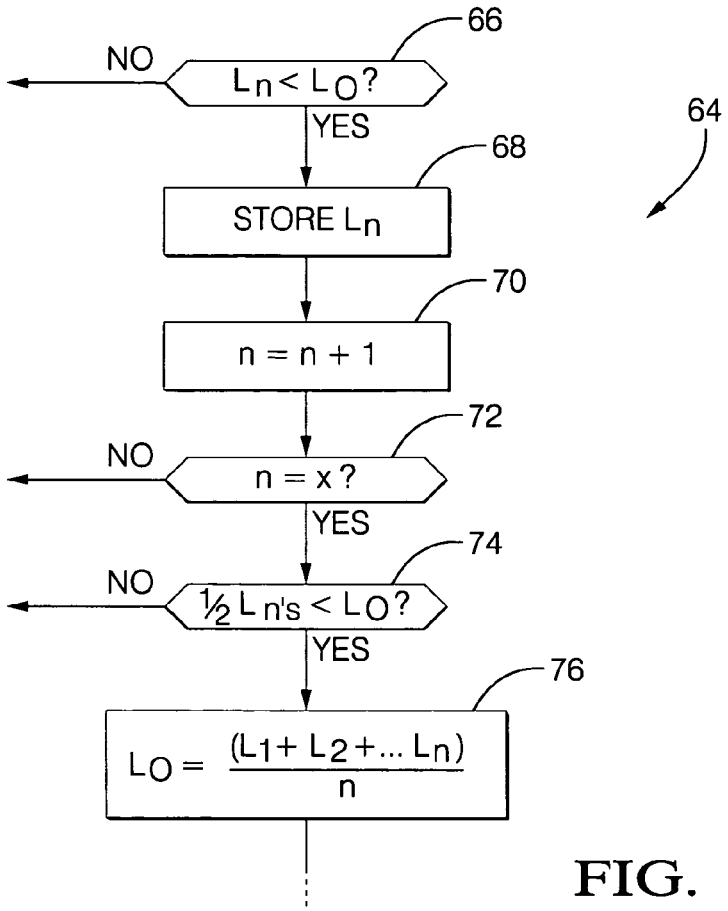
FIG. 6 is a logic chart of an alternative embodiment of the invention.

In order to prevent this uncertainty, an alternative embodiment to step 48 in FIG. 5 is graphically represented in FIG. 6. The alternative method for resetting the references is generally indicated at 64. The method begins by identifying a number n that will indicate the number of iterations in which the measurements for the oil level 14 are taken. A first oil level measurement $L_n$ is taken and measured to determine whether it is less than the reference oil level $L_o$. This step occurs at 66. The iterative oil level measurement $L_n$ is stored at 68. The counter n is increased by 1 at 70. It is then determined whether n has reached a limit x at 72. If not the alternative method 64 is released and the measurement method 30 is continued. If the counter has reached its limit x, and if at 74, one half of the iterative oil level measurements $L_n$ are less than the reference level $L_o$, the reference level $L_o$ is redefined as the average of all of the iterative level measurements $L_n$. This step occurs at 76.

Figure 7:
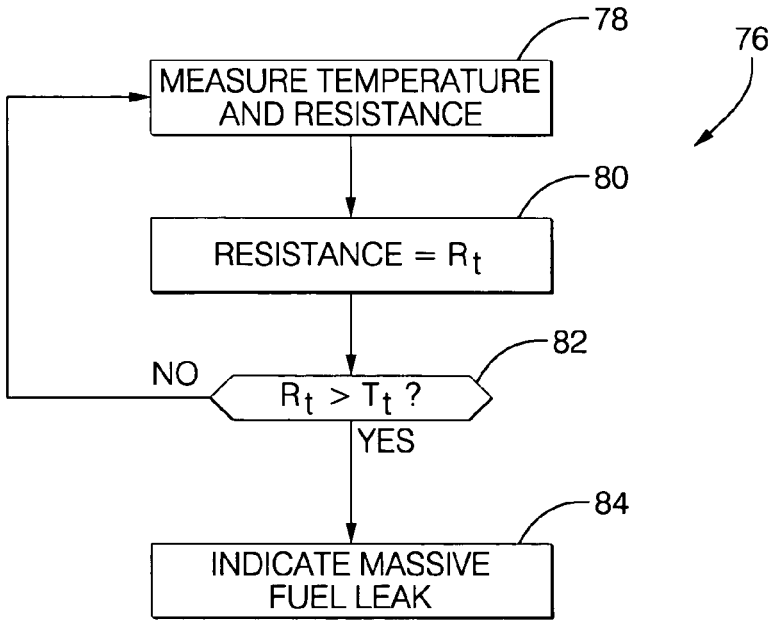
FIG. 7 is a logic chart of a method used to detect massive fuel leaks into oil.

Referring now to FIG. 7, a method is generally indicated at 76 that is used to detect when a massive fuel leak occurs. During operation of the internal combustion engine 12, a massive fuel leakage could occur due to the high pressure existing in fuel rails (not shown). When the motor vehicle 10 is running, oil is not typically added to the oil pan 16. In addition, normal engine oil degradation would not cause any significant short term changes in oil resistance K. Without the interference of these two factors, measuring the resistance K alone is enough to detect a massive instantaneous fuel leakage. In the method 76, temperature and resistance of the oil are measured at 78. The resistance is compensated with a temperature coefficient and then normalized with respect to its previous value at 80. It is then determined whether the normalized compensated resistance $R_t$ is greater than a predetermined threshold $T_t$ at 82. If so, it is indicated that a massive fuel leak has occurred at 84. If not, the method 76 loops back and continues to measure the temperature and resistance at 78. This method continues during the total operation of the internal combustion engine 12.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

What is claimed:

1. A method for detecting fuel leaking into an oil pan containing oil used to lubricate an internal combustion engine wherein the method utilizes a plurality of sensors, the method including the steps of:

measuring a plurality of parameters of the oil using each of the plurality of sensors to create measured values comprising the steps of:

measuring electrical resistance of the oil to create a resistance value;

measuring viscosity of the oil to create a viscosity value; and measuring a level of oil in the oil pan to create a level value;

calculating a fuel leakage value incorporating each of the measured values; and determining when the fuel leakage value exceeds a warning threshold.

2. A method as set forth in claim 1 including the step of indicating when the method determines the fuel leakage value exceeds the warning threshold.

3. A method as set forth in claim 1 including the step of cross correlating the resistance value and the level value.

4. A method as set forth in claim 3 including the step of measuring temperature of the oil when the internal combustion engine is started.

5. A method as set forth in claim 4 including the step of scoring the resistance, viscosity and level values as references.

6. A method as set forth in claim 5 including the step of repeating the step of measuring the plurality of parameters at a temperature difference elevated from the measurement taken when the internal combustion engine is started.

7. A method as set forth in claim 6 including the step of normalizing the measurements of the plurality of parameters.

8. A method as set forth in claim 7 including the step of measuring the plurality of parameters a subsequent time when the internal combustion engine is started the subsequent time to create a subsequent value.

9. A method as set forth in claim 8 including the step of scoring the subsequent values as references if a subsequent value for oil level is less than the level value.

10. A method as set forth in claim 8 including the step of repeating a plurality of times the step of measuring the plurality of parameters a subsequent time to create several sets of subsequent values.

11. A method as set forth in claim 10 including the step of storing a last set of the several set of subsequent values when a half of the several sets of subsequent values for oil level is less than the level value.

12. A method for detecting fuel leaking into an oil pan containing oil used to lubricate an internal combustion engine wherein the method utilizes a plurality of sensors, the method including the steps of:

measuring a resistance value of the oil to create a first measured value;

measuring a level value of the oil to create a second measured value;

cross correlating the resistance value and the level value;

calculating a fuel leakage value incorporating each of the first and second measured values; and determining when the fuel leakage value exceeds a warning threshold.

13. A method as set forth in claim 12 including the step of indicating when the method determines the fuel leakage value exceeds the warning threshold.

14. A method as set forth in claim 13 including the step of measuring electrical resistance of the oil to create a resistance value.

* * * * *